United States Patent [19]

Palmer et al.

[11] 4,136,660

[45] Jan. 30, 1979

[54] OIL PRESSURE FAILURE PROTECTION DEVICE FOR INTERNAL COMBUSTION ENGINES

[76] Inventors: Howard J. Palmer, 68 Gaywood Pl., Moraga, Calif. 94556; James R. Bechard, 170 Perkins St., Oakland, Calif. 94610

[21] Appl. No.: 851,046

[22] Filed: Nov. 14, 1977

[51] Int. Cl.[2] ..... F02B 77/08

[52] U.S. Cl. ..... 123/198 DC; 123/118; 123/148 S; 123/146.5 C

[58] Field of Search .... 123/198 D, 198 DC, 198 DB, 123/148 S, 196 S, 118, 146.5 C

[56] References Cited

U.S. PATENT DOCUMENTS

| | | | |
|---|---|---|---|
| 3,601,103 | 8/1971 | Swiden | 123/198 DC |
| 3,884,203 | 5/1975 | Cliffgard | 123/198 DC |
| 3,916,865 | 11/1975 | Kiencke et al. | 123/118 |
| 3,960,128 | 6/1976 | Anderson et al. | 123/198 DC |
| 3,964,461 | 6/1976 | Wesemeyer et al. | 123/198 DC |
| 4,023,549 | 5/1977 | Hewitt | 123/198 D |

*Primary Examiner*—Ira S. Lazarus

*Attorney, Agent, or Firm*—Harris Zimmerman

[57] ABSTRACT

A device for slowing an internal combustion engine in the event of oil pressure failure at an engine speed above idle, includes an SCR with the gate thereof connected to an engine rpm sensor which provides a voltage analog of engine speed. The SCR is connected between an oil pressure sensing switch typically provided for the engine, and the ignition distributor points. Should the oil pressure switch close, indicating low oil pressure, and the engine is turning at sufficient speed so that the rpm sensor provides enough voltage to the SCR gate, the SCR will fire and short the ignition.

8 Claims, 3 Drawing Figures

OIL PRESSURE FAILURE PROTECTION DEVICE FOR INTERNAL COMBUSTION ENGINES

This application constitutes an improvement over the device disclosed in our prior U.S. Pat. No. 4,054,117, issued Oct. 18, 1977.

BACKGROUND OF THE INVENTION

Modern automobiles and trucks are provided with sensors and warning systems which monitor the working functions of the vehicle engine and apprise the operator of serious malfunction. A major operating parameter of an internal combustion engine is the pressure of the lubricating oil, and any disruption of the lubricating system pressure is usually signalled by a dashboard warning light.

In internal combustion engines which are air cooled, and which rely on the lubricating system both for cooling and lubrication, failure of the lubricating system is a catastrophic event. Should the oil pressure fail, and the engine continues in operation, the engine will destroy itself in a matter of a very short time.

It is an unfortunate yet commonplace aspect of human nature that a vehicle operator who is concentrating on driving may ignore a dashbroad light and be totally unaware of an engine malfunction. Should the oil pressure fail at freeway cruising speeds, the driver will barely have time to stop the vehicle before the engine is damaged, even if he or she reacts immediately to the warning light. Clearly, a mere dashboard warning light system is insufficient.

The following U.S. patents exemplify the state of the art in devices which react to stop engine operation in the event of oil pressure failure: U.S. Pat. Nos. 3,914,735; 3,601,103; 3,362,388; 3,384,062; 3,116,729; 2,771,068; 2,445,625; 2,191,216.

Of these patents, U.S. Pat. No. 2,191,216 relates most directly to the present invention, in that it slows the engine to idle in the event of oil pressure failure; but this prior art system utilizes a solenoid device which must continuously be energized, unlike the present invention as detailed in the following.

SUMMARY OF THE INVENTION

The present invention generally comprises a device for sensing the oil pressure of an internal combustion engine and other engine operating parameters, and slowing the engine to idle speed should any of these parameters reach dangerous levels. The invention includes an SCR with one electrode connected through a diode to the oil pressure switch typically provided for the standard oil pressure warning system in a vehicle. The gate of the SCR is connected to a unique engine speed sensor which is optically coupled to the engine ignition. The other electrode of the SCR is connected directly to the ignition distributor points. The voltage produced by the engine speed sensor, which is proportional to the engine speed, is sufficient to turn on the SCR only when the engine is turning at a rate above idle speed.

Should the oil pressure fall, the pressure switch will close and ground the one electrode of the SCR. If the speed sensor voltage is sufficient to gate the SCR, the SCR will turn on and connect the distributor points to ground. The engine will immediately commence slowing, until it reaches approximate idle speed. At that point, the speed sensor voltage will be insufficient to operate the SCR gate, and the SCR will turn off. Thus the device will maintain the engine at idle speed while the oil pressure is low. The oil pressure warning light, together with the governing action of the device, will notify the driver of the engine malfunction. Further, the limiting of the engine to idle speed will minimize the damaging effects of the lack of proper lubrication. Also the driver-assisting power systems, such as power steering and power brakes, will continue to function, so that the vehicle may be operated safely and driven off of the road.

THE DRAWING

DESCRIPTION OF THE PREFERRED EMBODIMENT

Figure 1:
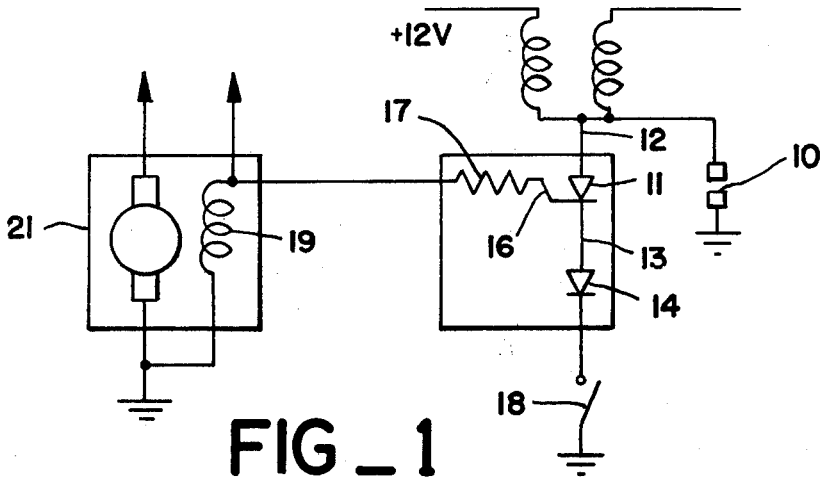
FIG. 1 is a schematic representation of one embodiment of the present invention, used in conjunction with generator-equipped vehicles.

The present invention is generally characterized as a device for protecting an internal combustion engine from oil pressure failure or other serious or destructive malfunctions. As shown in FIG. 1, one embodiment of the invention, for use with internal combustion engines employing a generator-powered electrical system, includes an SCR 11 which has one electrode 12 connected to the distributor points 10 of the engine. The gate 16 of the SCR is connected to a resistor 17, which in turn is connected to the field winding 19 of the engine generator 21. The electrode 13 of the SCR is connected to a forward biased diode 14, which is connected in turn to the normally open oil pressure sensing switch 18 of the vehicle. It should be noted that the switch 18 makes a direct connection to ground when the oil pressure falls below a predetermined value, and is connected to ground only when this situation occurs.

The resistor 17 serves both to limit the gate current applied to the gate 16, and to act as a voltage divider to apply only a small portion of the generator field voltage to the gate. Diode 14 is provided to prevent battery voltage from indicator lights, not shown, from back biasing the SCR. The voltage applied to the gate of the SCR is sufficient to fire the SCR only when the engine is turning its generator at nominal cruising speed. Should the oil pressure fall to an unsafe level, the switch 18 will close. The SCR is already armed by the generator field voltage, so that the distributor points are connected directly through the SCR and the switch 18 to ground. The spark plugs are thus prevented from firing and the engines stalls.

As the engine slows to an approximate idle speed, the generator field voltage falls until the voltage appearing at the gate 16 of the SCR 11 is insufficient to arm the SCR. The SCR turns off and the distributor points are no longer shorted to ground. Thus the engine is limited by the invention to operating at idle speed during a period of insufficient oil pressure. It may be appreciated that the value of the resistor 17 determines the speed to which the engine is limited during oil pressure failure, since it controls the amount of the generator voltage applied to the SCR gate.

In the descriptions of the embodiments of the present invention, it may be appreciated that the normally open grounding switch 18 may be sensitive to engine operating conditions other than oil pressure. For example, the switch 18 may be closed in response to such conditions as excessive engine temperature, low brake fluid level, electrical system failure, or the like. The example of oil pressure sensing of the switch 18 is merely illustrative, since failure of the lubrication system is so quickly destructive to an internal combustion engine.

Figure 2:
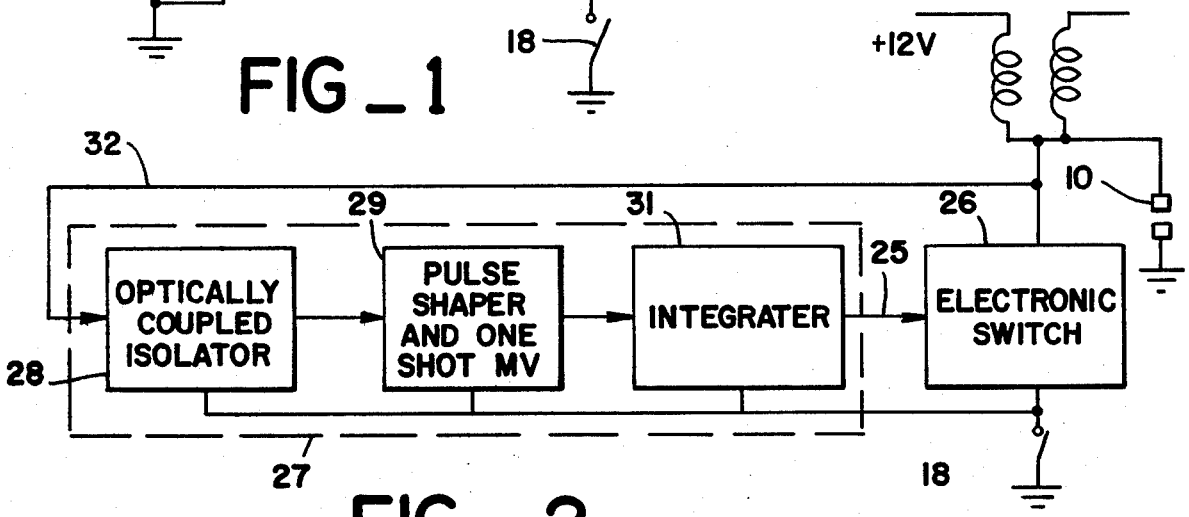
FIG. 2 is a block diagram representation of a further embodiment of the present invention.

Another embodiment of the present invention is shown diagrammatically by the block diagram of FIG. 2. It includes an electronic switch 26 which is connected in series between the breaker points 10 of the ignition system of the engine and the normally open grounding switch 18. The electronic switch 26 is connected through a trigger electrode 25 to an engine speed sensing device 27, as shown within the broken line of FIG. 2. The engine speed sensing device performs the same function as the field winding 19 of the generator 21 in FIG. 1; that is, it generates a voltage which is analogous to the engine speed, and this voltage is used to arm the electronic switch 26. The engine speed sensing device 27 may be used with engines which include a generator power supply, and may also be used with engines which are provided with alternator-type power supplies.

The engine speed sensing device 27 includes an optically coupled isolator 28 which receives pulses from the points 10 through line 32. The isolator 28 generates a light pulse in response to each voltage pulse from the points 10, and this light pulse is coupled to a phototransistor which in turn generates its own voltage pulse. The pulse output of the device 28 is completely electrically isolated from the high voltage ignition pulses from the points 10, thereby eliminating the requirement of any high voltage suppression or filters.

The pulse output from the optically coupled isolator 28 is received by a pulse shaper and one-shot multivibrator 29. The device 29 differentiates the voltage pulse waveform, and applies the differentiated voltage output to the input of a one-shot multivibrator. The one-shot multivibrator in turn is actuated to generate uniform output pulses approximately 4–5 milliseconds in duration. Thus each ignition voltage pulse from the points 10 is coupled through the isolator 28 to the device 29, and results in one pulse from the multivibrator of known duration and amplitude.

The output from the one-shot multivibrator is connected to an integrator 31. The integrator 31 is an operational amplifier integrator which generates a voltage output which is a function of the input frequency. Therefore, as the frequency of the pulses from the one-shot multivibrator increases, indicating that the engine speed is increasing, the output voltage of the integrator increases in a commensurate manner. Thus the output of the integrator 31, which is conducted through trigger electrode 25 to the electronic switch 26, is a voltage signal which is proportional to the speed of the engine of the vehicle. When this voltage exceeds the switching threshold level of the electronic switch 26, the electronic switch is armed. If the switch 18 is closed by a malfunction of the engine, such as low oil pressure, high engine temperature, or the like, the points 10 are connected directly through the electronic switch and the malfunction switch 18 to ground to defeat the engine ignition system. The high voltage portion of the ignition pulses are grounded, and the engine speed is reduced.

As the engine speed decreases, the isolator 28 continues to receive pulses as the points 10 open and close. Thus the engine speed sensor device 27 continues to operate, and the output voltage of the integrator 31 decreases in proportion to the decreasing engine speed. When the engine speed reaches a predetermined level, the voltage output of integrator 31 falls below the switching threshold of the electronic switch 26. At this point the electronic switch turns off, and the points 10 are no longer connected to ground. The engine ignition system is thus returned to operational status, and the sparkplugs once more fire. It may be appreciated that the engine speed is thus maintained at a predetermined minimum by the present invention during the time that the switch 18 is closed. This predetermined minimum permits the vehicle to be operated safely so that it may be driven safely off the road and repaired. The speed limitation is optimal in that it reduces to a minimum any damage which might result from the malfunction which is sensed by the switch 18, while permitting the vehicle driver to safely bring the vehicle to a halt. Any attempt to increase engine rpm while a malfunction is present will reactivate the electronic switch.

Figure 3:
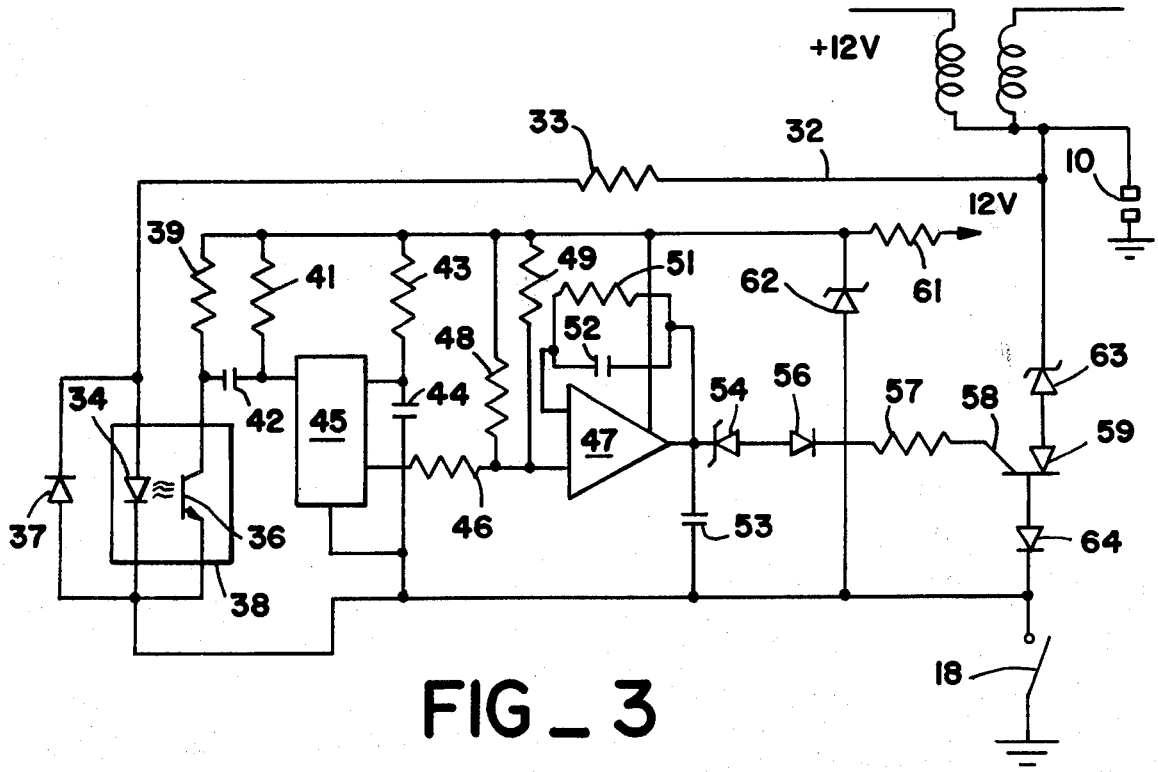
FIG. 3 is a schematic representation of the circuitry of the embodiment shown in FIG. 2.

As shown in the schematic diagram of FIG. 3, the voltage pulses from the engine ignition system are conducted from line 32 through a current limiting resistor 33 to an infra-red emitting diode 34. The diode 34 is optically coupled to an NPN photo transistor 36, and both the diode and the transistor are incorporated in an integrated circuit 38. A diode 37 is connected between the input and ground of the integrated circuit 38 to remove any reverse voltage transients which will damage the light emitting diode. Whenever the diode 34 emits light, the transistor 36 is actuated thereby to conduct. A load resistor 39 is connected in series between the power supply and the transistor 36, so that a voltage pulse appears across the resistor 39 whenever the transistor 36 is conducting.

Connected to the transistor side of resistor 39 is a capacitor 42, which in turn is connected to the input terminal of a one shot multivibrator 45. A resistor 41 is also connected between the power supply and the input terminal of the one shot multivibrator 45, and the capacitor 42 in conjunction with the resistor 41 forms a differentiating network. The integrated circuit 45 is a one-shot multivibrator which is triggered by the pulse provided by the differentiating network.

Resistor 43 and a capacitor 44 determine the duration of the pulse output of the one-shot multivibrator 45, which is approximately 4–5 msec in the preferred embodiment. This output pulse is coupled through resistor 46 to the input of integrated circuit 47. The inputs of the integrated circuit 47 are connected to the power supply through biasing resistors 48 and 49.

The output of integrated circuit 47, which is an operational amplifier, is connected through a parallel RC network comprising resistor 51 and capacitor 52 to one of the inputs of the operational amplifier. The RC network 51 and 52 together with the resistor 46 makes up an integrator which operates in conjunction with the operational amplifier. It should be noted that the gain of the operational amplifier is determined by the value of the resistor 46. The capacitor 53 acts as a filter to remove noise in the output circuit.

The output of the operational amplifier is connected to a zener diode 54 which prevents any offset voltage or circuit noise from arming the electronic switch. A diode 56 in series with the zener diode 54 prevents any high DC voltages from damaging the operational amplifier. A current-limiting resistor 57 is connected between the diode 56 and the gate 58 of an SCR 59, to connect the output of the operational amplifier 47 to the gate of the SCR. The power supply resistor 61 and zener diode 62 function together to limit the circuit operating voltage of the present invention to a safe level, and eliminate any high voltage transients which might damage or destroy the semiconductor devices in the circuit.

Connected in series with the SCR 59 is a zener diode 63 and a forward biased diode 64; the zener diode 63 is conductive when biased with more than approximately 20 volts.

The gate-switching threshold of the SCR 59 is determined by the value of the input resistor 46 of the operational amplifier 47. The value of the resistor 46 is selected so that whenever the engine is operating above idle speed, and a malfunction has closed switch 18, the output of the operational amplifier 47 is sufficient to arm the SCR 59.

With the SCR 59 armed, any malfunction which c closes the grounding switch 18 will connect the points 10 through the zener diode 63, the SCR 59 and the diode 64 to ground. In this event, all high voltage portions of the ignition pulses above the 20-volt limit set by the zener diode 63 will be shorted to ground. Ignition pulses below 20 volts are not effected, and the integrated circuit 38 operates normally as described in the foregoing. The circuit 27 will thus continue to monitor the engine speed and maintain the arming signal to the SCR 59 until the engine speed falls below the preset level. When the engine speed does fall below this preset level, and the sensing switch is still closed, the arming signal will be inhibited and ignition operation will return to normal. However, the engine speed cannot be increased above the preset level without reactivating the SCR. Therefore the engine will be maintained at the low preset level, apprising the driver that the vehicle has an immediate and serious problem. The vehicle can then be driven off the roadway as soon as possible.

It should be noted ahat all of the circuitry of the present invention, in all embodiments disclosed herein, are connected to ground through the sensing switch or switches 18. Thus no current flows through the circuitry unless the sensing switch is closed by a vehicle or engine malfunction. Thus the circuitry of the present invention is not operating, and draws no current, unless and until the switch 18 is closed. Thus the circuitry may not be operated for months or years, until a malfunction occurs. As a result the longevity and useful life of the present invention is greatly increased over prior art devices.

It should be noted that the present invention reduces the maximum speed of the vehicle engine to a predetermined level in the event of a malfunction, but does not stall the engine completely. Thus the driver-assisting power systems of the vehicle, such as power steering, power brakes, air conditioning, and the like will continue to operate in the event of a vehicle or engine malfunction. Thus the vehicle may be driven safely in the event of a malfunction and may be guided from the roadway.

We claim:

1. An engine malfunction protection device, comprising normally open engine malfunction sensing switch means having one pole connected to ground; a controlled switching means for limiting engine speed having one electrode connected to the other pole of said engine malfunction sensing switch means and another electrode connected to the spark forming portion of the engine ignition circuit; engine speed sensing means for generating an output signal analog of the speed of the engine, said output signal connected to the actuator of said controlled switching means, said actuator having a predetermined triggering threshold; and electrical power supply means, said engine speed sensing means being normally unpowered and connected directly to one side of said power supply means and connected through said engine malfunction sensing switch means to the other side of said power supply means.

2. The device of claim 1, wherein said engine speed sensing means includes pulse forming means actuated by the ignition pulses of said ignition circuit.

3. The device of claim 2, wherein said pulse forming means is optically coupled to said ignition pulses of said ignition circuit.

4. The device of claim 2, wherein said pulse forming means includes astable multivibrator means triggered by said ignition pulses.

5. The device of claim 4, further including integrator means for receiving the output of said astable multivibrator means and generating said output signal.

6. The device of claim 2, further including zener diode means connected between said spark forming portion of said engine ignition circuit and said another electrode of said controlled switching means to maintain sufficient voltage level of said ignition pulses to actuate said pulse forming means.

7. The device of claim 3, further including light emitting means actuated by said ignition pulses, and photosensitive means optically coupled to said light emitting means for generating pulses in correspondence with said ignition pulses.

8. The device of claim 5, wherein said integrator means includes an operational amplifier and an RC network feedback loop connected thereto.

* * * * *